United States Patent [19]

Vann

[11] 4,059,327

[45] Nov. 22, 1977

[54] RECESSED ELECTRICAL OUTLET

[76] Inventor: Donald S. Vann, 1601 Karen Circle, Magnolia, Ark. 71753

[21] Appl. No.: 672,625

[22] Filed: Apr. 1, 1976

[51] Int. Cl.[2] ..... H01R 13/60

[52] U.S. Cl. ..... 339/122 R; 174/56; 174/66; 339/133 R

[58] Field of Search ..... 339/132–134, 339/34, 122; 220/241, 242; 174/53–56, 66, 67; D8/179, 181; D26/1 B, 1 A

[56] References Cited

U.S. PATENT DOCUMENTS

| | | | |
|---|---|---|---|
| 1,857,377 | 5/1932 | Hubbell | 174/67 |
| 2,166,621 | 7/1939 | Budnick | 339/133 R |
| 3,609,647 | 9/1971 | Castellano | 339/122 R |
| 3,636,236 | 1/1972 | Smith | 220/241 |
| 3,652,781 | 3/1972 | Robbins | 220/242 |

*Primary Examiner*—Roy Lake
*Assistant Examiner*—Mark S. Bicks
*Attorney, Agent, or Firm*—Clarence A. O'Brien; Harvey B. Jacobson

[57] ABSTRACT

A recessed electrical outlet for improved safety and appearance is disclosed. A conventional type electrical receptacle is mounted upon a bracket structure which is substantially deeper than is conventional. A deeper than normal electrical box is also provided. The overall cover and protecting plate is similarly deeply recessed and especially designed and configured for use with the electrical receptacle of this device.

1 Claim, 3 Drawing Figures

RECESSED ELECTRICAL OUTLET

BACKGROUND OF THE INVENTION

This invention relates generally to electrical outlets and is an improvement thereover. The improved electrical outlet of this invention is deeply recessed and greatly improves both the safety factor of the electrical outlet as well as the appearance thereof.

DESCRIPTION OF THE PRIOR ART

Field of the Invention

A common problem with known electrical outlets is that with conventional type outlets an electrical plug when used with the outlet extends or protrudes a substantial distance from the wall itself. This is a safety hazard in that furniture can be pushed against or along the wall and will engage with said electrical plug and cord with a tendency to bend or damage them. In some cases the prongs of the plug become bent or the electrical cord becomes kinked, either of which can cause an electrical short and fire. These potential hazards will be completely eliminated with the improved electrical recessed outlet of this invention.

Another common problem with known electrical outlet type devices is that when furniture is covering the outlets and a person reaches behind the furniture to insert or remove an electrical plug, many times there is insufficient room behind the furniture and in front of the electrical outlet in order to properly pull on the electrical plug for removal of same. The electrical recessed outlet of this invention will eliminate this difficulty because the recessed outlet provides sufficient room to insert or remove the plug.

Known prior art patents which may be pertinent to this invention are as follows:

| | | |
|---|---|---|
| 2,015,698 | Tiffany | October 1, 1935 |
| 3,058,611 | Chester | October 16, 1962 |
| 3,636,236 | Smith | January 18, 1972 |
| 2,644,853 | Berninger et al | July 7, 1953 |

None of these known prior art devices offers the new and unique features of the invention disclosed herein.

SUMMARY OF THE INVENTION

An object of the present invention is to provide a recessed electrical outlet of improved appearance and greatly improved safety features.

Another object of the present invention is to provide a recessed electrical outlet which will permit the plug connected thereto to also be recessed and not protrude beyond the surface of the adjacent wall. Since the plug does not protrude, the overall safety is greatly increased. Furniture pushed along or against the receptacle will not damage the electrical connections thereto.

Another further object of this invention is to provide a recessed electrical receptacle which is much more convenient in use and function than conventional type receptacles.

A still further object of this invention is to provide an electrical outlet which is more attractive in appearance than conventional type outlets.

A still further object of this invention is to provide an electrical outlet which will have reduced maintenance and less chance of damage thereto than conventional type outlets.

The recessed electrical outlet disclosed herein has many advantages over known conventional type outlets. The safety, attractiveness, and convenience features are all important ones. For example due to the novel appearance of this outlet and the neatness of its functions, the outlet will be more desirable to the average person just because of its overall attractiveness.

Most of the advantages of this new recessed electrical outlet are directly or indirectly related to safety, but this device also offers the factor of convenience. For example, almost everyone has somewhere in their home an electrical outlet that is behind some heavy piece of furniture. Perhaps one can put their arm behind the furniture without moving it and can reach the electrical outlet, but then one finds that the plug cannot be pulled out or put back in because there is just not enough room between the furniture and the conventional electrical outlet in order to be able to move the plug into proper position. The recessed electrical outlet of this invention completely eliminates this problem. With this outlet there is sufficient room in which to insert or remove an electrical plug without moving any furniture which might be in front of it.

As mentioned above the most important feature of this invention is in the safety factor. As already discussed the fact that the plug inserted into the electrical outlet of this invention will not protrude and therefore will not be in a position to be easily damaged or injured by furniture or other items being pushed against or across same is a very important feature. These safety benefits are also important and apply to the recessed electrical outlet no matter where it may be located. Since the receptacle is recessed, any plug being used therewith also becomes recessed and therefore the chance of accident due to activities in homes, schools, factories, or buildings of any kind which might cause damage to the plug or cord will be eliminated or at least substantially reduced. Again, the new recessed electrical receptacle should substantially reduce the possiblity of electrical shock and fire due to damaged plugs or wires since the chance of damaged plugs in this new outlet will be virtually eliminated.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
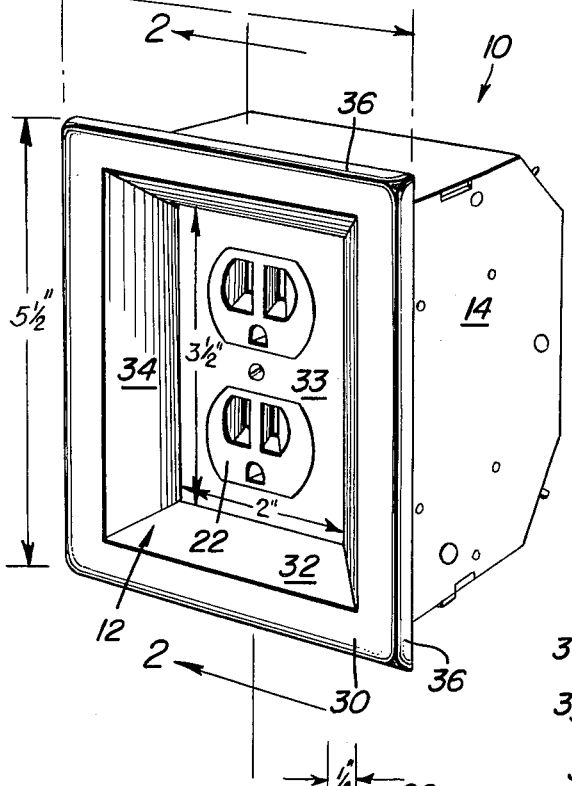
FIG. 1 is a perspective view of the recessed electrical outlet of this invention.

Referring to FIG. 1 of the drawings, reference numeral 10 indicates in general the deep electrical box with which this invention is used. Reference 12 indicates in general the recessed electrical outlet and the cover plate used therewith.

The figures of the drawing show an extra deep electric outlet box as envisioned by this invention for use by electricians in wiring a home, office building, etc. This box normally will be a depth of approximately 3½ inches. Normally 2½ inches in one of the deepest boxes commercially available. The electrical box 14 is provided with flanges 16 (FIG. 2) at the open side thereof for receiving the supporting bracket of an electrical outlet as is conventional in the trade. Looking at FIG. 2 the supporting bracket 20 for the electrical receptacle 22 may be clearly seen. This bracket normally is made of strong metal material and bent the desired configuration before being sold and supplied to the trade. The bracket 20 is connected or attached to the socket 22 by conventional means, not shown or described. The portions 24 of the bracket 20 are substantially longer than are conventional for the purpose of recessing the socket 22 deeply within the electrical box 14. Flanges 26 are appropriately provided on the outside tips of bracket portions 24 for attachment by means of screws 28 to the flanges 16 of the electrical box 14, as is conventional in the trade.

Once the electrical receptacle socket 22 and the extra deep bracket structure 20, 24, 26 is mounted and secured by the screws 28 to the electric box 14 mounted appropriately in the structure or walls of the building by attachment means as is conventional to the trade, a deeply recessed cover plate will be added to the combination and secured to the center hole 40 normally provided in the electric socket by means of a screw 42. The cover plate may be made of suitable plastic material or the like and provided in ivory, white, black, brown and any other appropriate colors for cover plates. This cover plate differs from conventional type cover plates in that the portions 30 and 33 are not in the same plane as normally provided in conventional type cover plates but are deeply separated by means of the deep recesses or flange portions 32 and 34. It is these deep recessed portions 32, 34 which together with the deep recessed support bracket 20 and 24 provide the inherent features as described above.

Figure 3:
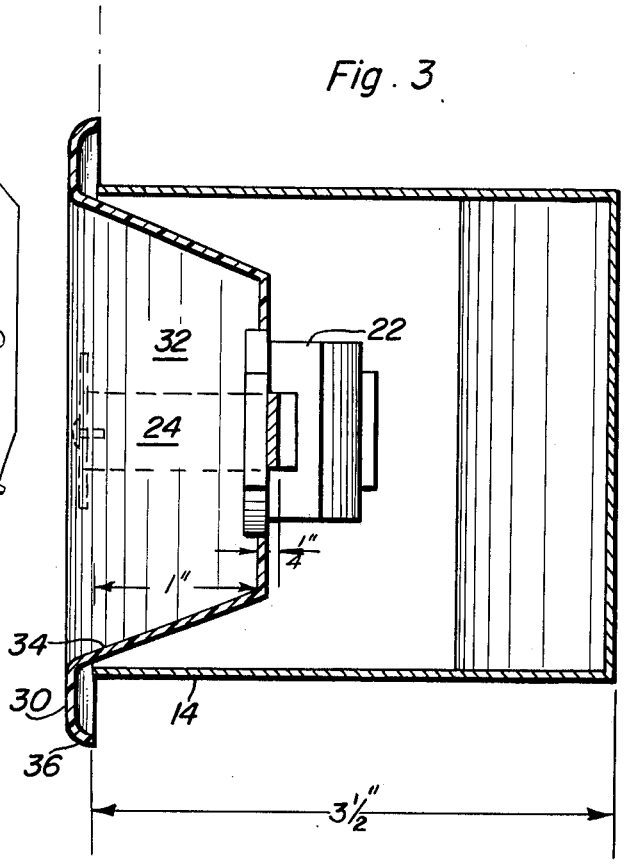
FIG. 3 is a top cross-sectional plan view taken generally along line 3 — 3 of FIG. 2.
Figure 2:
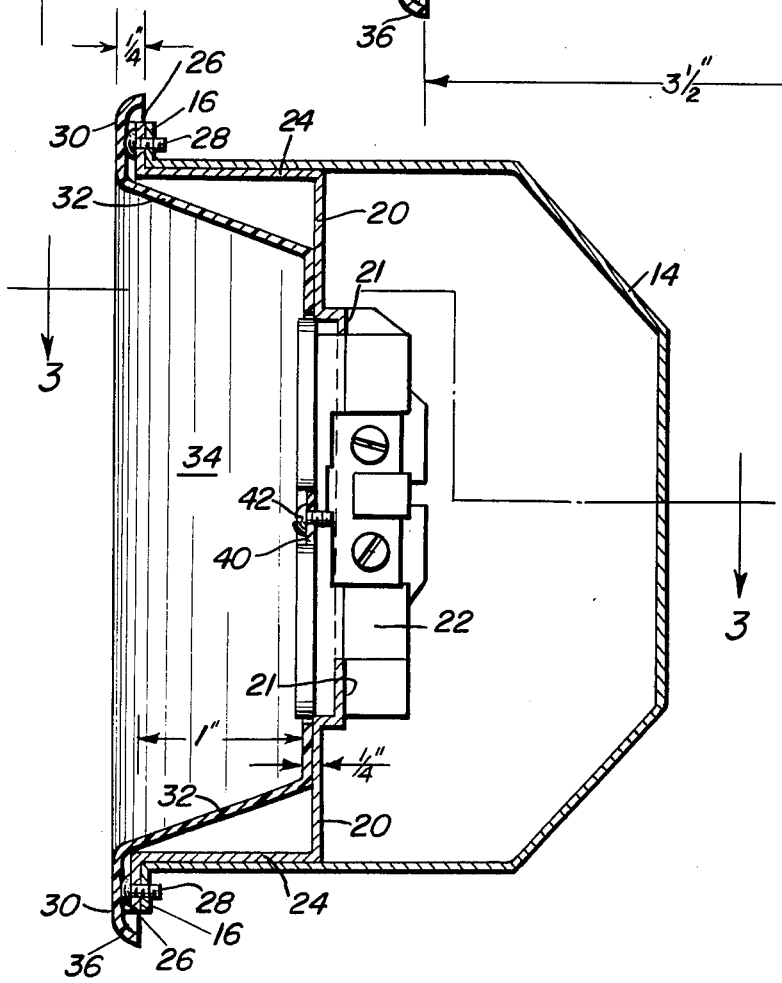
FIG. 2 is a vertical, cross-sectional view, taken generally along line 2 — 2 of FIG. 1.

The inventor has found the following dimensions to be appropriate for the device of this invention. The flange supporting structure 20, 21 which is normally provided by the manufacturer as a part of the electric receptacle 22 and mounted permanently on said receptacle by the portions 21, best seen in FIG. 2, is about 1 3/16 inch deep from the outer flange portions 26. In order to achieve the desired purpose of this invention this offset or recess should be at least 1 inch in depth. Normally the rectangular, dish-like cover plate will also be approximately 1 inch in depth from a plane taken across the adjacent will surface to the plane of the face of the electrical receptacle. This dimension is indicated in FIG. 3. The outer cover flange 30, 36 would normally be approximately ¼ inch in depth. The overall outer dimensions of the cover and protecting plate are shown as being approximately 4 inches in width by 5½ inches high. The recessed portion of the cover plate which is in a plane with the electric receptacle and immediately adjacent thereto has dimensions of approximately 2 inches wide by 3½ inches high. All of these dimensions may be varied slightly, but the ones indicated have been found to be very practical in every day application.

This improvement is relatively simple and relatively easy to produce and of only slightly more expense than conventional type electric outlets and cover plates. However the advantages and safety features far surpass those of the conventional type.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A recessed electric outlet comprising; means for substantially improving both the appearance and the safety factor of electrical receptacles and wall mounts therefor including, an electric box mounted in a wall of a building and including top and bottom flanges at the front edge thereof for reception of electric house wiring, an electrical receptacle mounted within said electric box for permanent connection to said wiring, said box including generally parallel top and bottom walls, said receptacle being vertically elongated and disposed in perpendicular relation to the top and bottom walls and generally centrally between the front and rear edges of the top and bottom walls, mounting means for supporting said electric receptacle deep within the electric box, and cover and protecting means attached to the electrical receptacle for covering the open portion of said electrical box to prevent access to the wiring contained therein, said mounting means for the electric receptacle including a deep offset bracket mounted on the electrical receptacle, said bracket being in the form of a narrow rigid strap having portions perpendicular to the top and bottom walls of the box, forwardly extending portions in surface-to-surface engagement with the top and bottom walls of the box and outwardly extending flanges overlying and attached to the flanges on the box by screws, said cover and protecting means including a rectangular dish-like structure having a deep recessed center portion attachable to the electrical receptacle by a center screw provided therewith and having the outer circumferential edge of the structure overlying the front edge of the electric box, the flanges thereon and the adjacent wall surface.

* * * * *